US005757333A

United States Patent [19]

Kitchener

[11] Patent Number: 5,757,333

[45] Date of Patent: May 26, 1998

[54] COMMUNICATIONS ANTENNA STRUCTURE

[75] Inventor: Dean Kitchener, Chemlsford, United Kingdom

[73] Assignee: Northern Telecom Limited, Montreal, Canada

[21] Appl. No.: 829,622

[22] Filed: Mar. 31, 1997

Related U.S. Application Data

[63] Continuation of Ser. No. 499,360, Jul. 7, 1995, abandoned.

[30] Foreign Application Priority Data

Jul. 9, 1994 [GB] United Kingdom ..... 9413881

[51] Int. Cl.[6] ..... H01Q 1/38; H01Q 21/29

[52] U.S. Cl. ..... 343/826; 343/829; 343/846

[58] Field of Search ..... 343/826, 828–831, 343/844–846, 806, 890, 891, 795, 792.5, 853; H01Q 21/29, 21/28, 1/38

[56] References Cited

U.S. PATENT DOCUMENTS

| | | | |
|---|---|---|---|
| 2,994,876 | 8/1961 | Josephson | 343/828 |
| 3,249,946 | 5/1966 | Flanagan | 343/792.5 |
| 4,763,131 | 8/1988 | Rosser et al. | 343/792.5 |
| 5,420,599 | 5/1995 | Erkocevic | 343/826 |

*Primary Examiner*—Michael C. Wimer
*Attorney, Agent, or Firm*—Lee, Mann, Smith, McWilliams, Sweeney & Ohlson

[57] ABSTRACT

A communications antenna structure, e.g. for a cellular radio base station comprises first and second bent folded monopole planar antenna elements mounted on a ground plane and disposed generally perpendicular to thereto. The antenna elements are mutually spaced from each other and are disposed with their respective planes at an angle to each other whereby to provide both polarisation diversity and space diversity of the antenna structure.

13 Claims, 5 Drawing Sheets

MEASURED AZIMUTH PATTERN FOR THE RIGHT HAND ELEMENT

MEASURED AZIMUTH RADIATION PATTERN FOR THE LEFT HAND ELEMENT

MEASURED ELEVATION RADIATION PATTERN FOR THE BS-1T RIGHT HAND ELEMENT

MEASURED ELEVATION RADIATION PATTERN FOR THE BS-1T LEFT HAND ELEMENT

COMMUNICATIONS ANTENNA STRUCTURE

This application is a continuation of application Ser. No. 08/499,360, filed Jul. 7, 1995, now abandoned.

This invention relates to cellular communications systems, and in particular to a base station antenna structure for such a system. The invention further relates to a base station incorporating the antenna structure.

BACKGROUND OF THE INVENTION

Cellular communications systems are being developed for use in a local area, e.g. in a factory or an office building to provide a wireless communications service. In such a system, communication takes place over a radio interface between user handsets and one or more base stations. Each base station is provided with an antenna structure whereby to communicate with user handsets in its particular service area. A requirement of the antenna structure is to provide polarisation and space diversity, i.e. to provide a substantially uniform beam pattern so that there are no 'dead' spots in the area served by the base station and so that the orientation of a user handset has substantially no effect on the call quality.

A further requirement of a base station antenna structure is to provide sufficient gain to service a significantly large area. it will be appreciated that, as base stations are relatively costly to manufacture and maintain, there is a significant cost advantage in providing effective service areas so as to minimise the number of base stations required for a particular installation. It has been found difficult to provide this gain in a compact antenna structure.

The conventional approach to the problem of achieving diversity is the provision of a simple dipole structure which has been found adequate for many applications. However, at the frequencies involved (typically 948 MHz) the dimensions of the conventional dipole may be inconveniently large. Urban planning authorities are now demanding that base stations that are exposed to public view be enclosed in a relatively unobtrusive plastics housing which is generally too small to accommodate both a conventional dipole and the electronic equipment required for operation of the base station. A number of small antenna structures have been described, for example a crossed drooping dipole structure described in specification number U.S. Pat. No. 4,686,536, and an integral diversity antenna described in specification number U.S. Pat. No. 5,138,328. A technique for antenna selection diversity is described in specification number EP-A-0,364,190. However, none of these arrangements provide the desired combination of both gain and diversity for successful employment as base station antenna.

The object of the invention is to minimise or to overcome this disadvantage.

It is a further object of the invention to provide a compact antenna structure having both gain and diversity properties.

SUMMARY OF THE INVENTION

According to the invention there is provided an antenna structure for a radio communications base station, the structure comprising a ground plane, and first and second bent folded monopole planar antenna elements mounted on said ground plane and disposed generally perpendicular to the plane thereof, wherein said elements are mutually spaced from each other and are disposed with their respective planes at an angle to each other whereby to provide both polarisation diversity and space diversity of the antenna structure.

We have found that the use of a pair of two-dimensional bent folded monopole antenna elements provides effective diversity and gain in a structure sufficiently small to be accommodated within a base station housing. We have also found that such a structure provides sufficient bandwidth for use in communications applications.

BRIEF DESCRIPTION OF THE DRAWINGS

An embodiment of the invention will now be described with reference to the accompanying drawings in which.

DESCRIPTION OF PREFERRED EMBODIMENT

Figure 1:
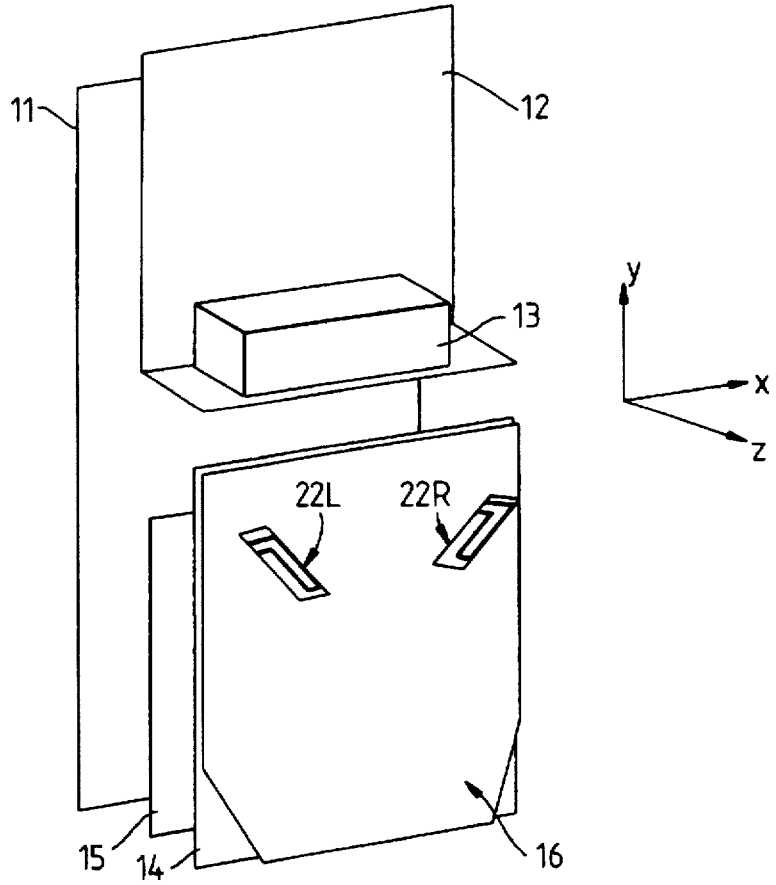
FIG. 1 is a general view of a communications base station incorporating an antenna structure.

Referring to FIG. 1, the base station includes a mounting plate 11 supporting an input/output module 12, a battery 13, a radio interface and base station control module board 14, a network interface and power supply module board 15 and an antenna assembly 16. In use, the base station components are environmentally enclosed in a plastics housing (not shown).

Figure 2:
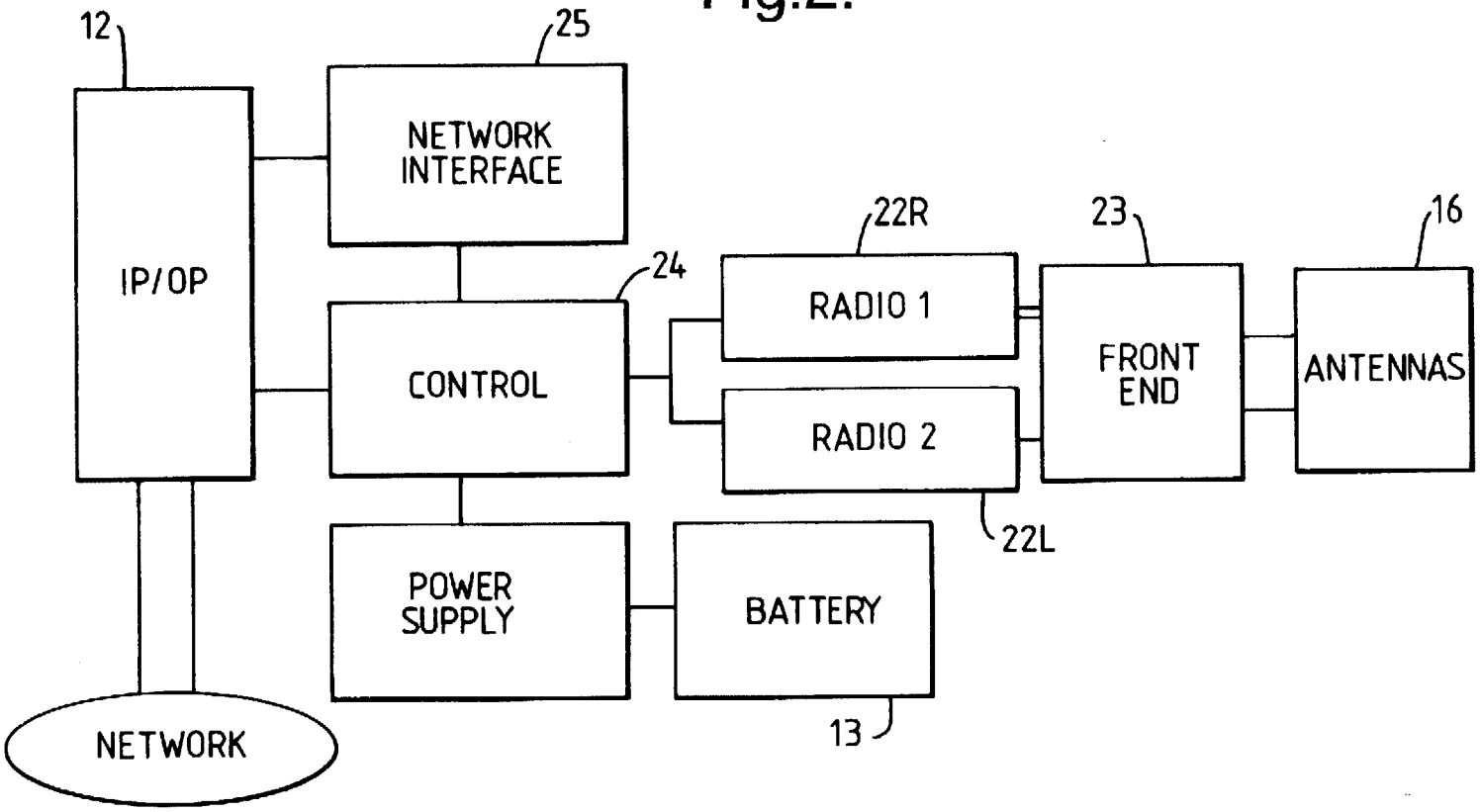
FIG. 2 is a schematic diagram of the base station of FIG. 1.

FIG. 2 shows the functional arrangement of the base station. The station supports a two RF channel cell. Operation of the station is controlled by the base station control module 24 which module is coupled to first and second radio modules 22R, 22L conveniently mounted on the same board 14 (FIG. 1) as the control module. The radio modules are coupled to the antenna assembly 16 via a common front end 23. The control module is also coupled to the network interface module 25, this interface module conveniently being disposed on the power supply board 15 (FIG. 1). Network access to the base station is provided via the input/output module 12. The two antennas comprising the antenna assembly are connected to both radio channels via a pair of splitter/combiners (not shown). Each channel implements a diversity algorithm to select between the antennas.

Figure 3:
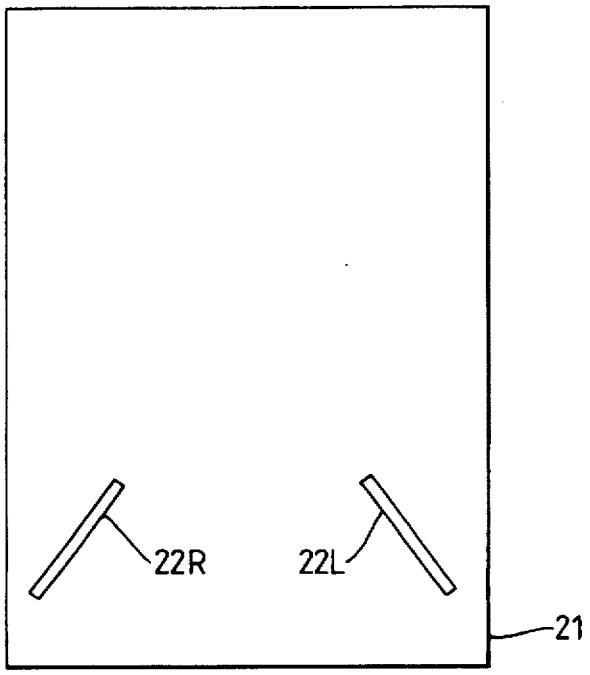
FIG. 3 is a plan view of the antenna structure of the base station of FIG. 1.

As can be seen from FIG. 3, the antenna structure comprises a conductive ground plane 21, e.g. a copper film coating on a plastics board, on which a pair of folded monopole planar antenna elements 22R, 22L are mounted, each element being arranged with its plane generally perpendicular to that of the ground plane 21. The antenna element 22R, 22L are spaced from each other and are disposed such that their respective planes are at an angle to each other. The two elements 22R and 22L are spaced by a distance which is preferably equivalent to one half of a wavelength. For example for operation at a frequency of 948 MHz, the spacing between the antenna elements may be about 17.5 cm. The angle between these planes of the elements may be from 45° to 70° and is preferably about 65°. Openings (not shown) are provided in the ground plane one for each antenna element whereby to provide for a coaxial feed to each element. This is conveniently a 50 ohm feed. In the arrangement of FIGS. 1 and 3, the antenna elements are fed each from a point close to the edge of the ground plane as this has been found to provide improved coverage in the backward hemisphere.

Figure 4:
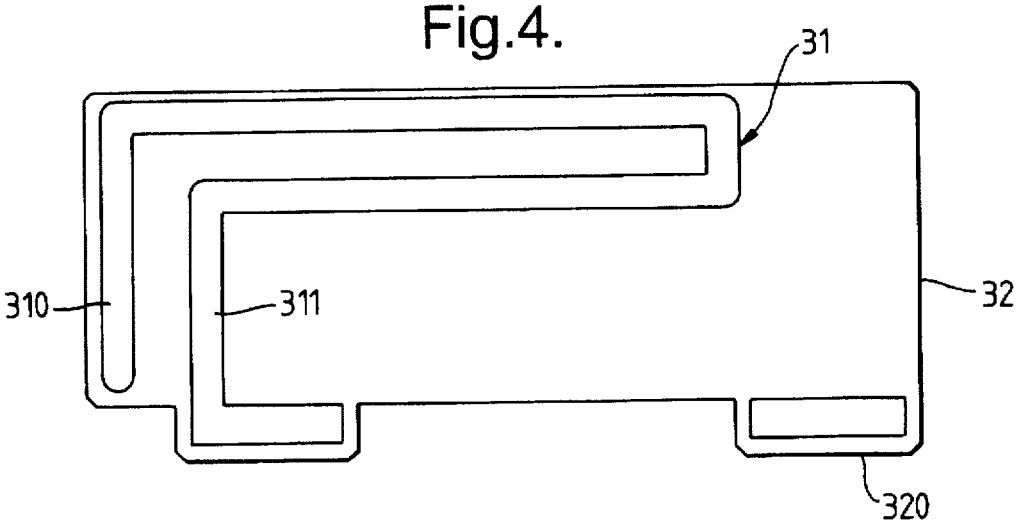
FIG. 4 shows an antenna element of the structure of FIG. 3 in further detail.

The construction of the antenna elements is shown in FIG. 4. Each element comprises a two-dimensional bent folded monopole, arranged so that part of the structure runs parallel to the ground plane, and may comprise a copper film pattern 31 disposal on an insulating support board 32. The board 32 may be provided with tabs or lugs 320 for engaging corresponding slots (not shown) in the ground plane whereby to ensure correct positioning and orientation of the antenna element. Advantageously, each antenna element is constructed as a double sided board so that the same structure may be employed for the left and right elements. Alternatively, each element may comprise a self supporting wire structure. In use a coaxial feed is provided to the longer vertical leg 310 of the structure, while the shorter vertical leg 311 is coupled e.g. by a solder connection, to the ground plane. The dimensions of each element are such that the sum of the height (a) above the board and the length (b) of the element portion lying parallel to the board is approximately equal to one quarter wavelength at the operating frequency. Thus, for operation at a frequency of 948 MHz and fed from a line of 50 ohms impedance, the monopole antenna may be about 2.5 cm in height and about 3.75 in length. This provides a compact structure suitable for accommodation within a restricted space.

Figure 5:
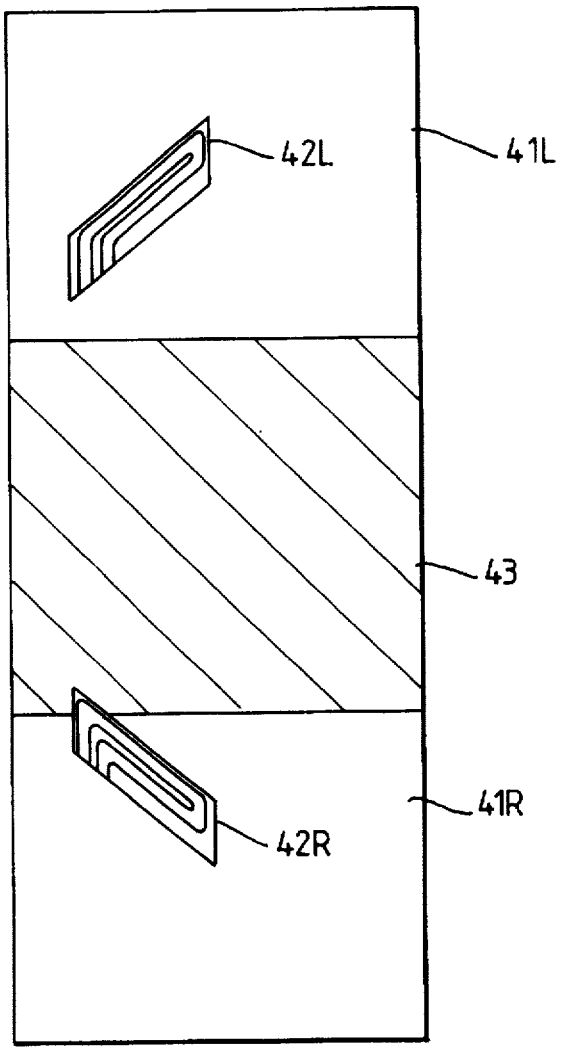
FIG. 5 shows an alternative antenna structure.

An alternative diversity antenna pair construction is shown in FIG. 5. In this arrangement the ground plane comprises two discrete portions 41R, 41L on each of which a respective antenna element 42R, 42L is mounted. There is thus an unmetallised portion 43 at the centre of the board on which the ground plane is formed. Each antenna element is fed from a point adjacent the inward edge of the respective ground plane portion.

Figure 6:
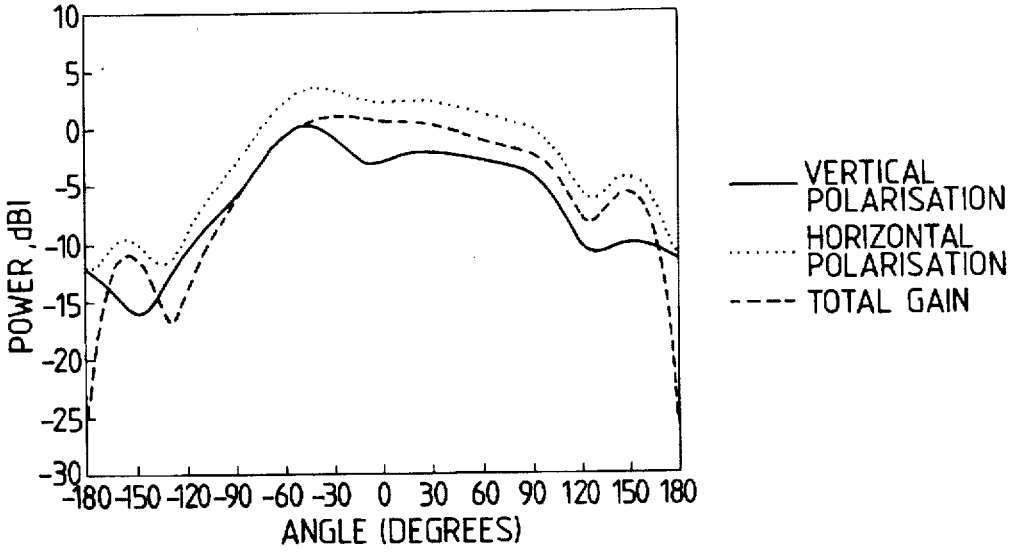
FIGS. 6 and 7 respectively illustrate the azimuth radiation patterns of the left and right antenna elements of the antenna structure shown in FIG. 3.
Figure 7:
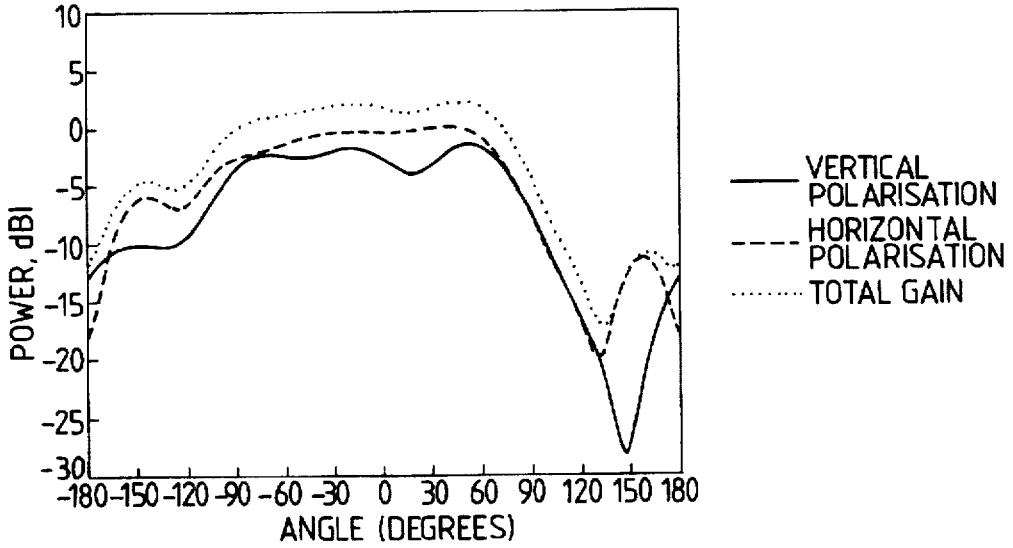
Figure 8:
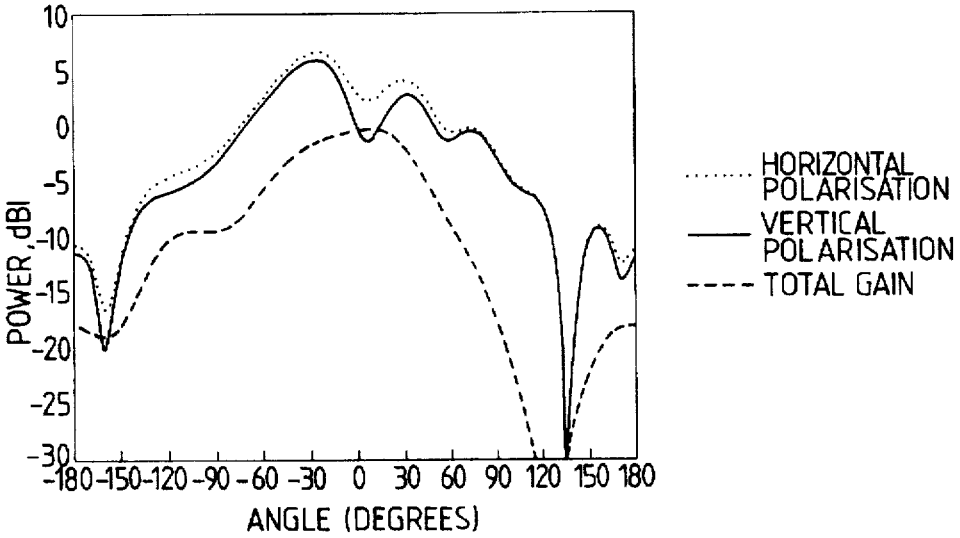
FIGS. 8 and 9 respectively illustrate the elevation radiation patterns of the left and right antenna elements of the antenna structure shown in FIG. 3.
Figure 9:
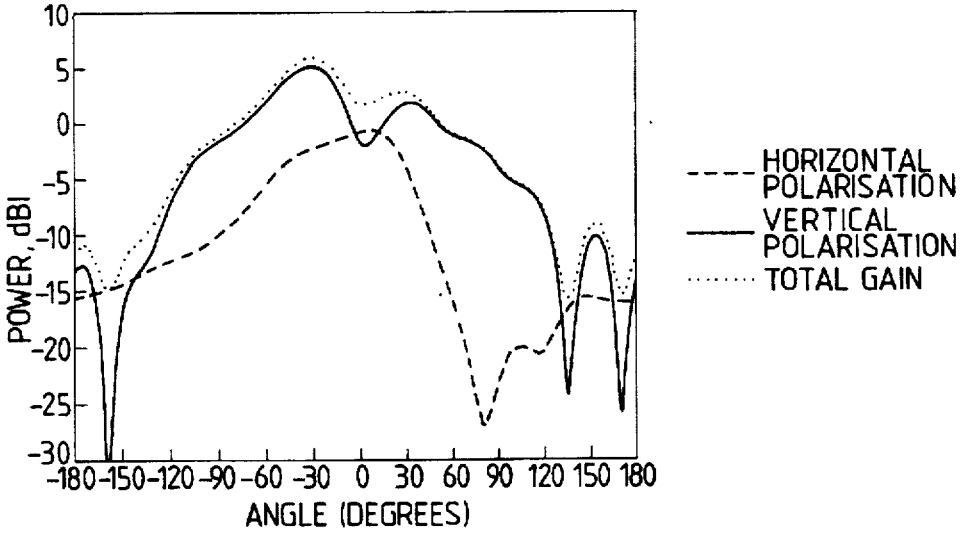

To demonstrate the feasibility of the antenna structure described above, propagation/diversity measurements have been made. The results of these measurements for the right and left element of the antenna pair are illustrated in FIGS. 5 and 6 which shown azimuth radiation patterns and in FIGS. 7 and 8 which show elevation in radiation patterns. In each figure, the angle is measured from the z-axis (i.e. the vertical axis) so that 0° is the boresight direction. In the XZ plane the angle increases positively from Z to Y. Measurements were made with a mobile antenna (simulating a handset) transmitting in vertical polarisation, horizontal polarisation and slant (45°) polarisation. These measurements demonstrate that the antenna structure described above has effective gain and diversity despite its compact physical dimensions.

Although the antenna structures have been described above with particular reference to communications base stations, they are not limited to that particular application but are also of general application to high frequency transmission and reception.

I claim:

1. A narrow band antenna structure for a radio communications base station arranged to provide communication between the base station and a mobile terminal at one or other of respective first or second mutually orthogonal electric field vector polarisation directions, the structure comprising a conductive ground plane which, in use, is mounted in a generally vertical plane, an insulating planar support board disposed adjacent the ground plane and parallel thereto, and first and second bent folded monopole planar antenna elements mounted on said support board and each disposed generally perpendicular to the plane thereof, wherein said antenna elements are spaced from one another and are mutually disposed at an angle of 45° to 75° between their respective planes so as to provide both polarisation diversity and spatial diversity of the antenna structure.

2. An antenna structure as claimed in claim 1, wherein said ground plane comprises a conductive metal film disposed on the insulating support board.

3. An antenna structure as claimed in claim 2, wherein each said antenna element comprises a conductive metal film pattern disposed on a respective further insulating support board.

4. An antenna structure as claimed in claim 3, wherein said metal film pattern is disposed on two opposing faces of said respective further support board.

5. An antenna structure as claimed in claim 4, wherein each said antenna element support board is provided with mounting tabs for engaging corresponding openings in the ground plane whereby to define the spatial relationship of the antenna elements and to define an electrical connection between the antenna element and the ground plane.

6. An antenna structure as claimed in claim 5, wherein said ground plane is divided into two discrete portions one for each said antenna element.

7. An antenna structure as claimed in claim 1, wherein the antenna elements are spaced by a distance equivalent to one half of a wavelength at the operating radio frequency.

8. A communications base station incorporating one or more antenna structures as claimed in claim 1.

9. A base station for a mobile communications system comprising a generally laminar support plate, said support plate, in use, being disposed in a generally vertical plane, a radio transceiver mounted on the support plate and having first and second communication channels coupled to a common front end, a power supply mounted on the support plate and coupled to the radio transceiver, base station control means associated with the radio transceiver, and a narrow band antenna structure coupled to the radio transceiver, wherein said antenna structure comprises a conductive ground plane disposed parallel with the support plate, an insulating planar support board disposed adjacent the ground plane and parallel thereto, and first and second bent folded monopole planar antenna elements mounted on said support board and each disposed generally perpendicular to the plane thereof, wherein said antenna elements are spaced from one another and are mutually disposed at an angle of 45° to 75° between their respective planes so as provide both polarisation diversity and spatial diversity of the antenna structure, and wherein each said channel has means for selecting one or other of the first and second antenna elements so as, in use, to establish communication with a mobile terminal via that antenna element having the greater received signal strength from the mobile terminal.

10. A base station as claimed in claim 9, wherein said ground plane comprises a conductive metal film disposed on the insulating support board.

11. A base station as claimed in claim 10, wherein each said antenna element comprises a conductive metal film disposed on a respective further insulating support board.

12. A base station as claimed in claim 11, wherein said metal film is disposed on two opposing faces of said further insulating support board.

13. A base station as claimed in claim 12, wherein each said antenna element support board is provided with mounting tabs for engaging corresponding openings in the ground plane whereby to define the spatial relationship of the antenna elements and to define an electrical connection between the antenna element and the ground plane.

* * * * *